US011241070B2

(12) United States Patent
Kannally

(10) Patent No.: US 11,241,070 B2
(45) Date of Patent: Feb. 8, 2022

(54) ANTI-THEFT POCKET INSERT

(71) Applicant: Thomas Kannally, Schoolcraft, MI (US)

(72) Inventor: Thomas Kannally, Schoolcraft, MI (US)

( * ) Notice: Subject to any disclaimer, the term of this patent is extended or adjusted under 35 U.S.C. 154(b) by 390 days.

(21) Appl. No.: 16/267,493

(22) Filed: Feb. 5, 2019

(65) Prior Publication Data

US 2019/0239610 A1 Aug. 8, 2019

Related U.S. Application Data

(60) Provisional application No. 62/627,358, filed on Feb. 7, 2018.

(51) Int. Cl.

| | |
|---|---|
| ***A45C 13/18*** | (2006.01) |
| ***A41D 27/20*** | (2006.01) |
| ***A45C 1/02*** | (2006.01) |
| ***A45C 1/06*** | (2006.01) |
| ***A45F 5/02*** | (2006.01) |

(52) U.S. Cl.

CPC ..... *A45C 13/185* (2013.01); *A41D 27/20* (2013.01); *A45C 1/024* (2013.01); *A45C 1/06* (2013.01); *A45C 13/18* (2013.01); *A45F 5/022* (2013.01)

(58) Field of Classification Search

CPC .... A41D 27/20; A41D 27/202; A41D 27/201; A45F 5/022; A45C 1/06

USPC ..... 2/250

See application file for complete search history.

(56) References Cited

U.S. PATENT DOCUMENTS

| | | | | | |
|---|---|---|---|---|---|
| 1,513,784 | A | * | 11/1924 | Roesner | A45C 13/185 24/13 |
| 1,821,809 | A | * | 9/1931 | Johnson | A41D 27/20 2/254 |
| 3,981,028 | A | | 9/1976 | Siegel | |
| 4,154,275 | A | * | 5/1979 | Cauley | A45C 15/00 150/106 |
| 4,388,734 | A | * | 6/1983 | Cowden | A45C 13/185 2/250 |
| 4,602,390 | A | * | 7/1986 | Morera | A41D 27/20 2/247 |
| 4,716,600 | A | | 1/1988 | Beek | |
| 4,899,395 | A | | 2/1990 | Spector | |
| 5,121,864 | A | * | 6/1992 | Geschwind | A45C 13/185 150/131 |

(Continued)

*Primary Examiner* — John K Fristoe, Jr.
*Assistant Examiner* — Justin Caudill
(74) *Attorney, Agent, or Firm* — Boudwin Intellectual Property; Daniel Boudwin

(57) ABSTRACT

An anti-theft pocket insert designed to prevent a pickpocket from stealing items stored within a traditional pocket. The anti-theft pocket insert includes a first fabric member having a front surface and a rear surface. A second fabric member is affixed to the front surface of the first fabric member such that a compartment having an interior volume designed to hold a passport or wallet is formed. An upper side of the second fabric member is not affixed to the first fabric member such that an opening in communication with the interior volume is formed. Further, the first fabric member is greater in length than the second fabric member such that a top edge of the first fabric member overhangs the opening. In this way, a user is able to store items inside the anti-theft pocket insert and place the insert within a pocket to prevent pickpockets from stealing the items.

7 Claims, 2 Drawing Sheets

(56) References Cited

U.S. PATENT DOCUMENTS

| | | | | |
|---|---|---|---|---|
| 5,678,620 | A * | 10/1997 | Mayled | A45C 1/06 150/102 |
| 6,760,926 | B1 * | 7/2004 | Miller | A45C 1/08 150/136 |
| 10,226,091 | B2 * | 3/2019 | Cowan | A41D 27/201 |
| 2009/0014104 | A1 * | 1/2009 | Duchon | A45C 1/08 150/136 |
| 2010/0101000 | A1 * | 4/2010 | Hanson | A41D 1/06 2/234 |
| 2013/0298312 | A1 | 11/2013 | Rapp | |

* cited by examiner

ANTI-THEFT POCKET INSERT

CROSS REFERENCE TO RELATED APPLICATIONS

This application claims the benefit of U.S. Provisional Application No. 62/627,358 filed on Feb. 7, 2018. The above identified patent application is herein incorporated by reference in its entirety to provide continuity of disclosure.

BACKGROUND OF THE INVENTION

The present invention relates to pocket inserts. More specifically, the invention provides a first fabric member affixed to a second fabric member to form an interior volume configured to store items therein, wherein the first fabric member is configured to secure inside a traditional pocket.

Many people store valuable items inside their pockets while traveling, such as cash, a wallet, or a passport. Unfortunately, these valuable items are typically susceptible to being pickpocketed by thieves. When wallets or passports are stolen, it can be an arduous and expensive exercise to replace the items taken. Although there are items a person can wear that are designed to thwart thieves, these items are often costly, or cumbersome to wear. Thus, an improved anti-theft pocket insert that can removably secure to the inside of a pocket to prevent a pickpocket from stealing items therein is needed. Further, it is desirable to provide an anti-theft pocket insert that specifically rests against the wearer's leg and positions a hand entering the pocket in a front to back orientation.

SUMMARY OF THE INVENTION

In view of the foregoing disadvantages inherent in the known types of pocket inserts now present in the known art, the present invention provides an anti-theft pocket insert wherein the same can be utilized for providing convenience for the user when desiring to use a pocket to carry items while preventing a pickpocket from stealing items therein.

The present system comprises an anti-theft pocket insert. The anti-theft pocket insert includes a first fabric member having a front surface and a rear surface. The anti-theft pocket insert additionally includes a second fabric member affixed to the front surface of the first fabric member such that a compartment having an interior volume is formed therebetween. An upper side of the second fabric member is not affixed to the first fabric member such that an opening in communication with the interior volume is formed. Further, the first fabric member is greater in length than the second fabric member such that a top edge of the first fabric member overhangs the opening. In this way, a user is able to store valuable items within the anti-theft pocket insert and store the insert within a pocket to prevent pickpockets from stealing the items therein.

One object of the present invention is to provide an anti-theft pocket insert that can be effectively utilized in front pants pockets, rear pants pockets, jackets, purses, backpacks, and any other garment or storage device that includes pockets.

Another object of the present invention is to provide an anti-theft pocket insert that includes an embodiment that is integrated into a garment or storage device when the garment or storage device is manufactured.

A further object of the present invention is to provide an anti-theft pocket insert that better protects the contents of the user's existing clothing or preferred clothing of choice so that the user does not have to resort to buying specialty clothing at a higher price.

Yet another object of the present invention is to provide an anti-theft pocket device that can be composed of the pocket material of the clothing with which the device is used, which improves the effectiveness of the device by concealing the appearance of the device in jackets, purses, backpacks, and the like.

Still a further object of the present invention is to provide an anti-theft pocket device that creates a barrier of defense between the contents of the pocket and the hand of another person seeking to steal the contents. A very important part of this invention is the creation of "empty space" between the back of any pocket (closest to the user) and the invention device which will prohibit an intruder from direct contact with the protected item(s). Also, this empty space between the device and the user could cause the intruder to make undesired contact with the user triggering an alert to the user. The device, when in use, could also help prevent inadvertent loss of pocket contents.

Other objects, features, and advantages of the present invention will become apparent given the following detailed description and accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
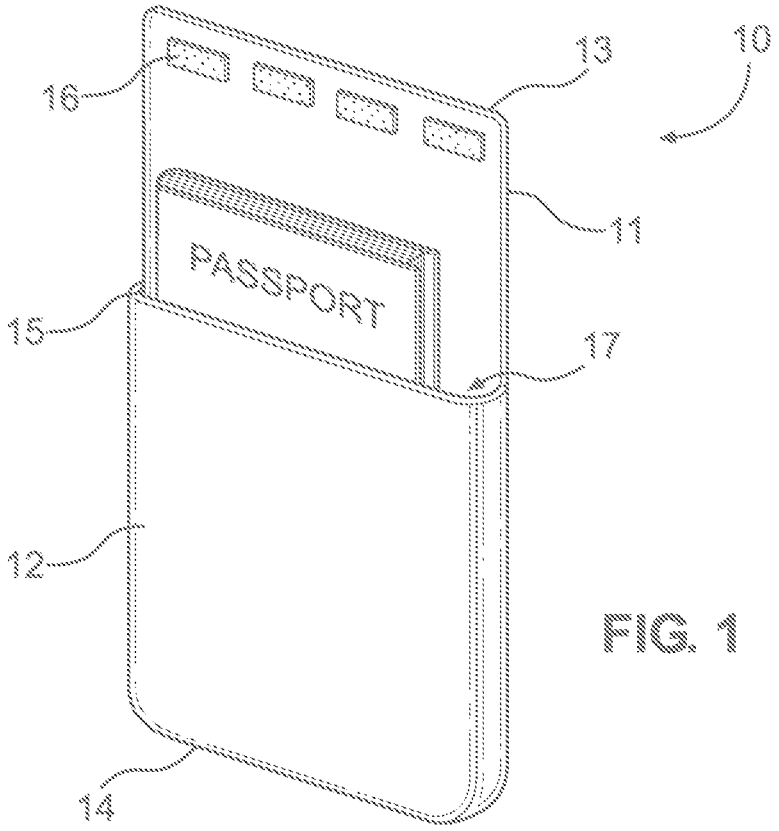
FIG. 1 shows a perspective view of an embodiment of the anti-theft pocket insert.

Reference is made herein to the attached drawings. Like reference numerals are used throughout the drawings to depict like or similar elements of the anti-theft pocket insert. The figures are intended for representative purposes only and should not be considered to be limiting in any respect.

Referring now to FIG. 1, there is shown a perspective view of an embodiment of the anti-theft pocket insert. An anti-theft pocket insert 10 is intended to affix to the interior of a traditional pocket to allow the user to convince a potential thief the pocket is empty while still retaining the ability to carry valuable items therein, thereby preventing a potential theft.

The anti-theft pocket insert 10 comprises a first fabric member 11, having an inner surface and an outer surface, and a second fabric member 12, also having an inner surface and an outer surface. The second fabric member 12 is affixed to the first fabric member 11 such that both inner surfaces are positioned facing one another, and both outer surfaces are positioned away from one another. The second fabric member 12 is sealed at a bottom edge 14 to the first fabric member 11 and unsealed at an aperture edge 15, such that an interior volume 17 is formed between the first fabric member 11 and the second fabric member 12. The aperture edge 15 forms an opening in communication with the interior volume 17 configured to store items therein.

The first fabric member 11 is greater in length than the second fabric member 12, such that a top edge 13 of the first fabric member 11 overhangs the aperture edge 15 of the second fabric member 12 when the first fabric member 11 is sealed to the second fabric member 12 at the bottom edge 14. The anti-theft pocket insert 10 is configured to sit within the interior of a pocket, such that the second fabric member 12 is disposed flush against the inward facing interior side of the pocket, and the aperture 15 faces the body of the person.

In the illustrated embodiment, at least one fastener 16 is affixed to the inner side of the first fabric manner 11. The fasteners 16 are configured to removably affix the anti-theft pocket insert 10 to the interior of a compartment, such as a pocket of a pair of jeans or a purse. In the shown embodiment, the fasteners 16 are disposed along the top edge 13 of the first fabric member 11. In this way, the fasteners 16 allow the anti-theft pocket insert 10 to be securely disposed within the compartment, thereby preventing the anti-theft pocket insert 10 from falling and opening within the compartment.

In the illustrated embodiment, the fasteners 16 comprise a plurality of hooks configured to removably secure the top edge 13 to the interior of the individual's pocket such that the anti-theft pocket insert 10 can be removed without damaging the interior of the pocket. In the shown embodiment, the plurality of hooks 16 comprise four sections, wherein each section is distinct from one another and includes two rows of hooks disposed across the entire surface area of the section.

Figure 2:
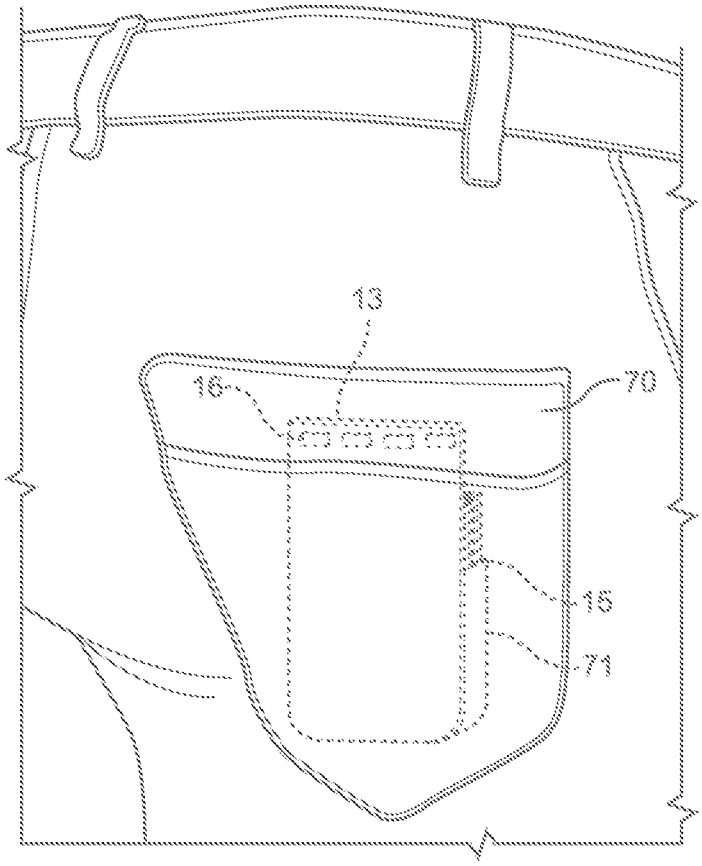
FIG. 2 shows a front perspective view of an embodiment of the anti-theft pocket insert in use.

Referring now to FIG. 2, there is shown a front perspective view of an embodiment of the anti-theft pocket insert in use. In the illustrated embodiment, the anti-theft pocket insert is affixed to the rear pocket 70 of a pair of jeans using the fasteners 16. As such, in the illustrated embodiment the anti-theft pocket insert is composed of a material similar to the material of the jeans, such as denim or corduroy. In other embodiments, the anti-theft pocket insert can be composed of any suitable fabric or other types of materials. Additionally, in the shown embodiment, the first fabric member and the second fabric member are each configured to be planar. In this way, the anti-theft pocket insert is configured to fool a potential pickpocket into believing the anti-theft pocket insert is one side of the pant's pocket 70, thereby convincing the thief the pocket 70 is empty.

In the shown embodiment, the fasteners 16 are configured to affix to an outward-facing interior surface 71 of the pocket 70. However, in additional embodiments, the anti-theft pocket insert can be affixed to a body-facing interior surface of the pocket 70, such that the items placed therethrough the aperture edge 15 are positioned flush against the body of the user. Additionally, the anti-theft pocket insert should be positioned such that the top edge 13 of the first fabric member is aligned proximal to the opening of the pocket 70, such that any items placed therein do not fall out of the aperture edge 15 of the anti-theft pocket insert. The fasteners 16 may include fabric glue, low profile individual fasteners, fastener strips, or any other fastener that enables users to properly install the device.

Figure 3:
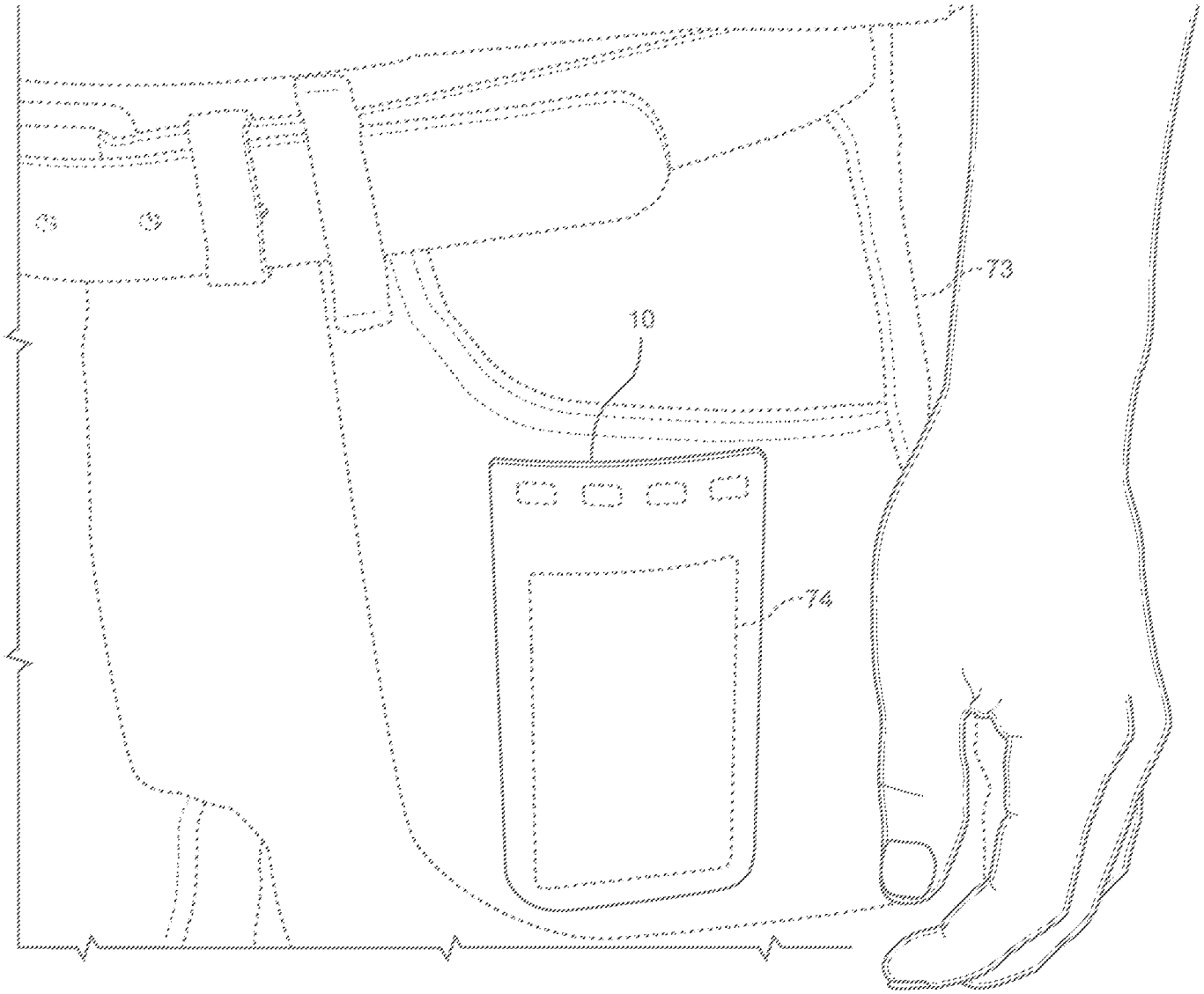
FIG. 3 shows a rear perspective view of an embodiment of the anti-theft pocket insert in use.

Referring to FIG. 3, there is shown a rear perspective view of an embodiment of the anti-theft pocket insert in use. In operation, a user will place one or more items 74 within the interior volume of the anti-theft pocket insert 10. The user can then utilize the fasteners along the top edge of the first fabric member to affix the anti-theft pocket insert 10 to the interior of the pocket of the user's pants 73 or, in some embodiments, the user's purse. In one embodiment, the user will position the anti-theft pocket insert 10 such that the aperture edge of the second fabric member is facing the body of the user. In this way, an individual attempting to pick-pocket the user will be fooled into believing the pocket is empty by feeling only the outer surface of the anti-theft pocket insert, thereby providing the user protection against the theft. In other words, the interior of the insert must face outwardly from the front of the garment or contrivance with which it is utilized, thereby preventing access to its contents by an intruder. The contents of the garment or contrivance pocket can only be accessed when the user flips the device out of the pocket, presumably in a secure environment where it is safe to remove valuables of any kind.

When the insert is installed within a pocket, it creates an empty space between the back of the pocket adjacent the user's body and the device, which will prohibit an intruder from directly contact the protected item or items. Also, this empty space between the device and the user could cause the intruder to make undesired contact with the user, thereby alerting the user that a pickpocket is attempting to gain access to their pockets. In this way, the anti-theft pocket both protects the contents of the user's pocket from theft and alerts users of potential thefts as they are in progress. In practice, the user should install the insert into a top area of the pocket lining by turning the garment inside out if using mechanical fasteners, or by simply gluing the device inside the pocket if using adhesives. This conceals the device from others. Additionally, the fabric or material used by the device can extend all the way down to the closed lower end of the pocket. In some embodiments, an additional length of fabric or material can be included in order to form a larger sub-pocket within the protected space. This prohibits intruders from gaining direct access to the protected items and provides enough length material for the user to grasp and flip the device out of their pocket to access the contents easily.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An anti-theft pocket insert, comprising:

a first fabric member having a front surface and a rear surface;

a second fabric member affixed to the front surface of the first fabric member such that a compartment having an interior volume is formed therebetween;

wherein an upper side of the second fabric member is not affixed to the first fabric member such that an opening in communication with the interior volume is formed;

wherein the first fabric member is greater in length than the second fabric member such that a top edge of the first fabric member overhangs the opening;

an adhesive fastener disposed on the front surface along a top edge of the first fabric member and positioned above the opening;

wherein the second fabric member is configured to sit flush against a body-facing interior side of a pocket, such that the adhesive fastener secures the front surface of the first fabric member to the body-facing interior surface of the pocket, whereby the top edge of the first fabric member is disposed between the interior of the pocket and an item placed within the interior volume of the compartment;

whereby the anti-theft pocket insert creates an empty space between a back of the pocket adjacent a wearer's body and the anti-theft pocket device, which will prohibit an intruder from directly contacting an item stored in the interior volume of the anti-theft pocket insert.

2. The anti-theft pocket insert of claim 1, wherein the anti-theft pocket insert is composed of denim.

3. The anti-theft pocket insert of claim 1, wherein the first fabric member is planar.

4. The anti-theft pocket insert of claim 1, wherein the second fabric member is planar and includes a front face that is free from attachments.

5. A method of protecting oneself from a pickpocket, comprising:

placing an item inside an interior volume of an anti-theft pocket insert, the anti-theft pocket insert comprising a first piece of fabric and a second piece of fabric secured together, wherein the first piece of fabric has a length greater than the second piece of fabric, wherein the first piece of fabric includes an adhesive fastener disposed on a front surface thereof;

securing the anti-theft pocket insert inside a garment pocket by attaching the adhesive fastener to a body-facing interior side of the pocket, such that the second piece of fabric is positioned flush against the body-facing interior side of the pocket;

whereby the anti-theft pocket insert creates an empty space between a back of the pocket adjacent the garment wearer's body and the anti-theft pocket device, which will prohibit an intruder from directly contacting an item stored in the interior volume of the anti-theft pocket insert.

6. An anti theft pocket insert and garment assembly comprising:

a lower body garment configured to be worn about a waist of a wearer;

at least one pocket disposed on the lower body garment;

a pocket insert comprising a first fabric member having a front surface and a rear surface;

a second fabric member affixed to the front surface of the first fabric member such that a compartment having an interior volume is formed therebetween;

wherein an upper side of the second fabric member is not affixed to the first fabric member such that an opening in communication with the interior volume is formed;

wherein the first fabric member is greater in length than the second fabric member such that a top edge of the first fabric member overhangs the opening;

wherein the front surface of the first fabric member is attached to a body-facing interior side of the at least one pocket via an adhesive fastener disposed on the front surface along a top edge of the first fabric member and positioned above the opening;

wherein the second fabric member is configured to sit flush against the body-facing interior side of the at least one pocket of the lower body garment, such that the second fabric member is disposed between an interior of the at least one pocket and an item placed within the interior volume, whereby the top edge of the first fabric member being connected to the at least one pocket prevents access to the opening of the compartment when the compartment is disposed within the pocket;

whereby the anti-theft pocket insert creates an empty space between a back of the pocket adjacent the garment wearer's body and the anti-theft pocket device, which will prohibit an intruder from directly contacting an item stored in the interior volume of the anti-theft pocket insert.

7. The anti theft pocket insert and garment assembly of claim 6, wherein the at least one pocket and the pocket insert are composed of the same materials.

* * * * *